US008708656B2

(12) United States Patent
Barnett et al.

(10) Patent No.: US 8,708,656 B2
(45) Date of Patent: Apr. 29, 2014

(54) BLADE FIXING DESIGN FOR PROTECTING AGAINST LOW SPEED ROTATION INDUCED WEAR

(75) Inventors: Barry Barnett, Markham (CA); Philippe Bonniere, Toronto (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 357 days.

(21) Appl. No.: 12/786,902

(22) Filed: May 25, 2010

(65) Prior Publication Data

US 2011/0293429 A1 Dec. 1, 2011

(51) Int. Cl.
*F01D 5/30* (2006.01)

(52) U.S. Cl.
USPC ..... 416/219 R; 416/204 A; 416/244 A; 416/248

(58) Field of Classification Search
USPC ..... 416/204 A, 219 R, 220 R, 221, 244 A, 416/248
See application file for complete search history.

(56) References Cited

U.S. PATENT DOCUMENTS

| | | | | |
|---|---|---|---|---|
| 3,936,234 | A | 2/1976 | Tucker et al. | |
| 4,208,170 | A | 6/1980 | Tucker et al. | |
| 4,265,595 | A | 5/1981 | Bucy, Jr. et al. | |
| 4,453,891 | A | 6/1984 | Forestier | |
| 4,482,296 | A * | 11/1984 | Wassell et al. | 416/215 |
| 4,483,661 | A | 11/1984 | Manharth et al. | |
| 4,645,425 | A | 2/1987 | Morrison, Jr. | |
| 5,123,813 | A | 6/1992 | Przytulski et al. | |
| 5,163,817 | A | 11/1992 | Violette et al. | |
| 5,205,713 | A | 4/1993 | Szpunar et al. | |
| 5,205,714 | A | 4/1993 | Shah et al. | |
| 5,263,898 | A | 11/1993 | Elston, III et al. | |
| 5,275,536 | A * | 1/1994 | Stephens et al. | 416/248 |
| 5,350,279 | A | 9/1994 | Prentice et al. | |
| 5,431,542 | A | 7/1995 | Weisse et al. | |
| 5,443,366 | A | 8/1995 | Knott et al. | |
| 5,993,162 | A | 11/1999 | Weisse et al. | |
| 6,592,330 | B2 | 7/2003 | Leeke et al. | |
| 6,739,837 | B2 | 5/2004 | Barnette et al. | |
| 6,846,159 | B2 | 1/2005 | Zabawa et al. | |
| 6,905,311 | B2 | 6/2005 | Leathart | |
| 6,951,448 | B2 | 10/2005 | Duesler et al. | |
| 7,594,799 | B2 * | 9/2009 | Miller et al. | 416/219 R |
| 2008/0226457 | A1 * | 9/2008 | Belmonte | 416/219 R |
| 2009/0104041 | A1 * | 4/2009 | Bruce | 416/241 R |

* cited by examiner

*Primary Examiner* — Nathaniel Wiehe
*Assistant Examiner* — Justin Seabe
(74) *Attorney, Agent, or Firm* — Norton Rose Fulbright Canada LLP

(57) ABSTRACT

The blade dovetails and associated dovetail slots of a gas turbine engine rotor assembly are shaped so that during windmilling the high stress regions of the blade dovetails are shielded from rubbing against the disk and vice versa. Bumper surfaces are provided in low stress regions of the dovetail assembly such that the windmilling contact points between the blade dovetails and the disk are in non-critical areas of the dovetail assembly.

11 Claims, 3 Drawing Sheets

BLADE FIXING DESIGN FOR PROTECTING AGAINST LOW SPEED ROTATION INDUCED WEAR

TECHNICAL FIELD

The application relates generally to gas turbine engines and, more particularly, to a new blade/disk fixing design for protecting predetermined regions of a blade root and/or disk from low speed rotation induced wear.

BACKGROUND OF THE ART

Turbofan blades are typically provided with blade dovetail which are loosely mounted in complementary-shaped dovetail slots defined in the outer periphery of the rotor hub of the fan rotor. At engine operating speeds, the blades are urged firmly in position by the centrifugal force, thereby locking the blade dovetails against movement in the associated dovetail slots. However, when the fan rotates at low speeds, such as during windmilling, the centrifugal force is not sufficient to prevent the blade dovetails from moving in the dovetail slots. Windmilling may occur when wind blows through the engine of a parked aircraft causing the fan rotor to slowly rotate. Windmilling can also occur when an aircraft crew shutdown a malfunctioning or damaged engine in flight. The continued forward motion of the aircraft forces ambient air through the fan blades causing the fan rotor to rotate at low speed.

The opposing gravitational forces on the blade during such low speed rotation cause the blade to chafe against the disk due to the play at the joint between the disk and the blades. This low load high cycle event causes wear of the contacting surfaces. Such low speed rotation or windmilling induced wear can result in wear in critical stress locations and, thus, lead to premature retirement of blades and disk from service.

It is know, therefore, to provide an insert or spacer between the rotor disk and the blade root, to force the blade to its outward operating position, thus, reducing blade root movement during windmilling, and thus wear. Theses inserts are extra parts requiring extra time to make and install. They contribute to the overall complexity of the engine.

Accordingly, there is a need to provide a new and simple protection against windmilling induced wear.

SUMMARY

In one aspect, there is provided a fan rotor assembly of a gas turbine engine, comprising a disk mounted for rotation about a centerline of the engine, an array of circumferentially distributed dovetail slots defined in an outer periphery of the disk, a corresponding array of fan blades attachable to the disk, each fan blade having a blade dovetail engageable in a corresponding one of the dovetail slots, the blade dovetail having high stress regions and low stress regions, the low stress regions having a sacrificial bumper which will wear in preference to the high stress regions of the blade dovetail, the sacrificial bumper providing for a closer tolerance fit in the dovetail slots than the high stress regions, thereby shielding the high stress regions from rubbing against the disk when the rotational speed of the turbofan assembly is too low to centrifugally lock the fan blades in position on the disk.

In a second aspect, there is provided a gas turbine engine rotor assembly comprising a rotor disk mounted for rotation about an axis and having a plurality of blade mounting slots circumferentially distributed about a periphery of the rotor disk for receiving complementary blade fixing portions of a set of blades, wherein each blade fixing portion has low stress regions and high stress regions, and wherein bumper surfaces are provided in the low stress regions away from the high stress regions so that when the rotational speed of the rotor assembly is too low to centrifugally lock the blades in position on the disk, the bumper surfaces contact the disk and shield the high stress regions from contacting the disk, thereby protecting the high stress regions of the blade fixing portions from low speed rotation induced wear.

DESCRIPTION OF THE DRAWINGS

Reference is now made to the accompanying figures, in which.

DETAILED DESCRIPTION

Figure 1:
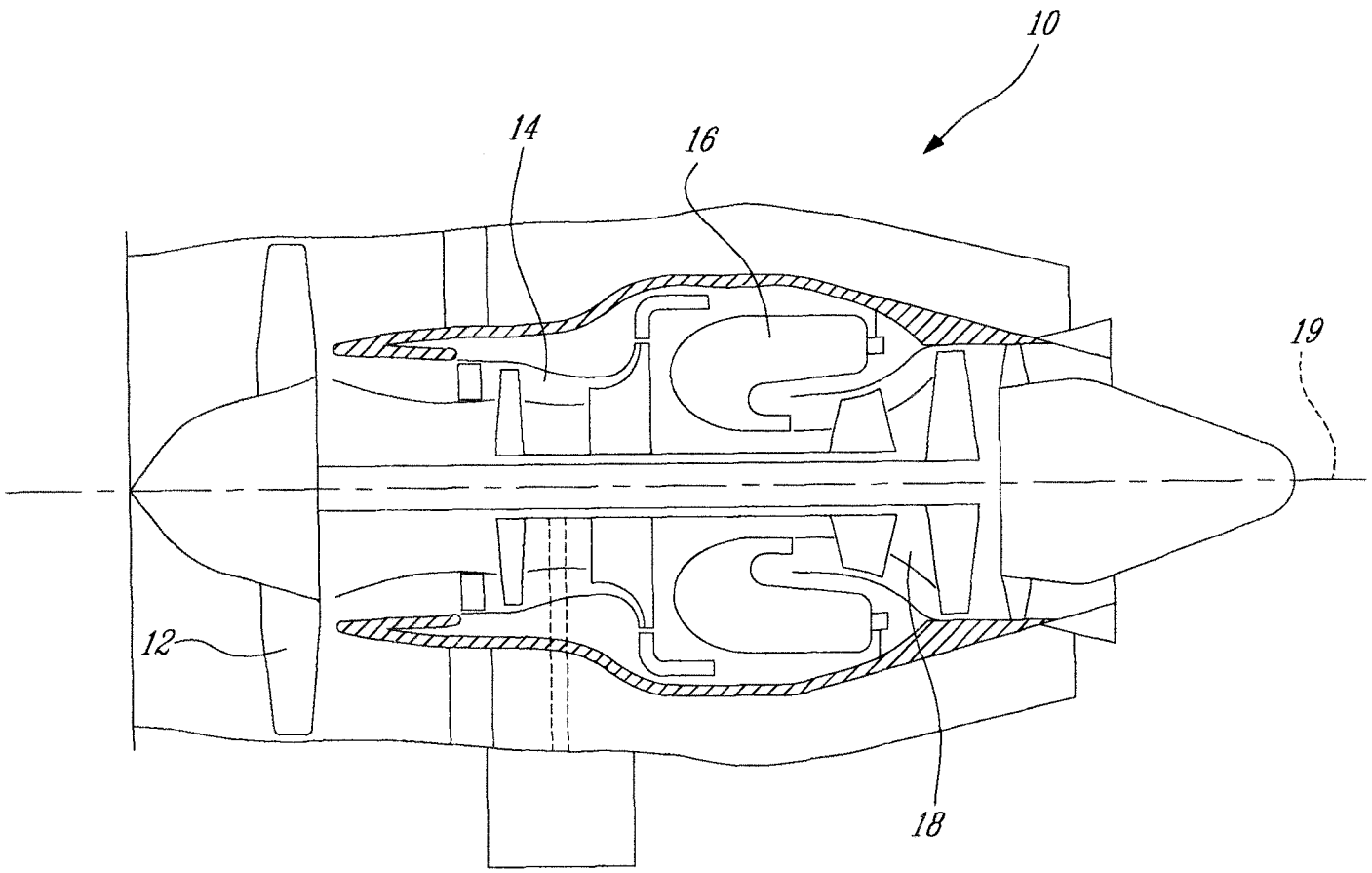
FIG. 1 is a schematic cross-section side view of a turbofan engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

The fan 12 includes a disk 20 (FIGS. 2 and 3) mounted for rotation about the engine centerline 19. A plurality of circumferentially spaced-apart blade mounting slots 22 are defined in the outer periphery of the disk 20. The slots 22 may be provided in the form of dovetail slots. Each slot 22 is axially bounded by a pair of opposed sidewalls 24 extending longitudinally in the axial direction from a front side to a rear side of the disk 20. The term "axial" is herein intended to refer not only to directions strictly parallel to the engine centerline 19 but also to directions somewhat non-parallel thereto but having a predominantly axial component. Each slot 22 is bounded in a radial direction by a radially outwardly facing bottom 26 and a pair of overhanging lugs 28 provided at an upper end of the sidewalls 24 and having radially inwardly facing bearing surfaces 30. A pair of bumper surfaces 53 is provided at the mouth of each slot 22 that is radially outwardly from the bearing surfaces 30. The slot bumper surfaces 53 may be parallel and symmetrically disposed about the slot centerline. The slot bumper surfaces 53 may be substantially flat. However, it is understood that the bumper surfaces 53 could adopt other suitable configurations. For instance, they could have a concave profile. A pair of bottom corner disk fillets 31 is defined between the bearing surfaces 30 and the slot bottom 26. The slot bottom 26 covers all the features in zone which extends between fillets 31 including the central undercut defined in the bottom surface of each slot 22.

Figure 3:
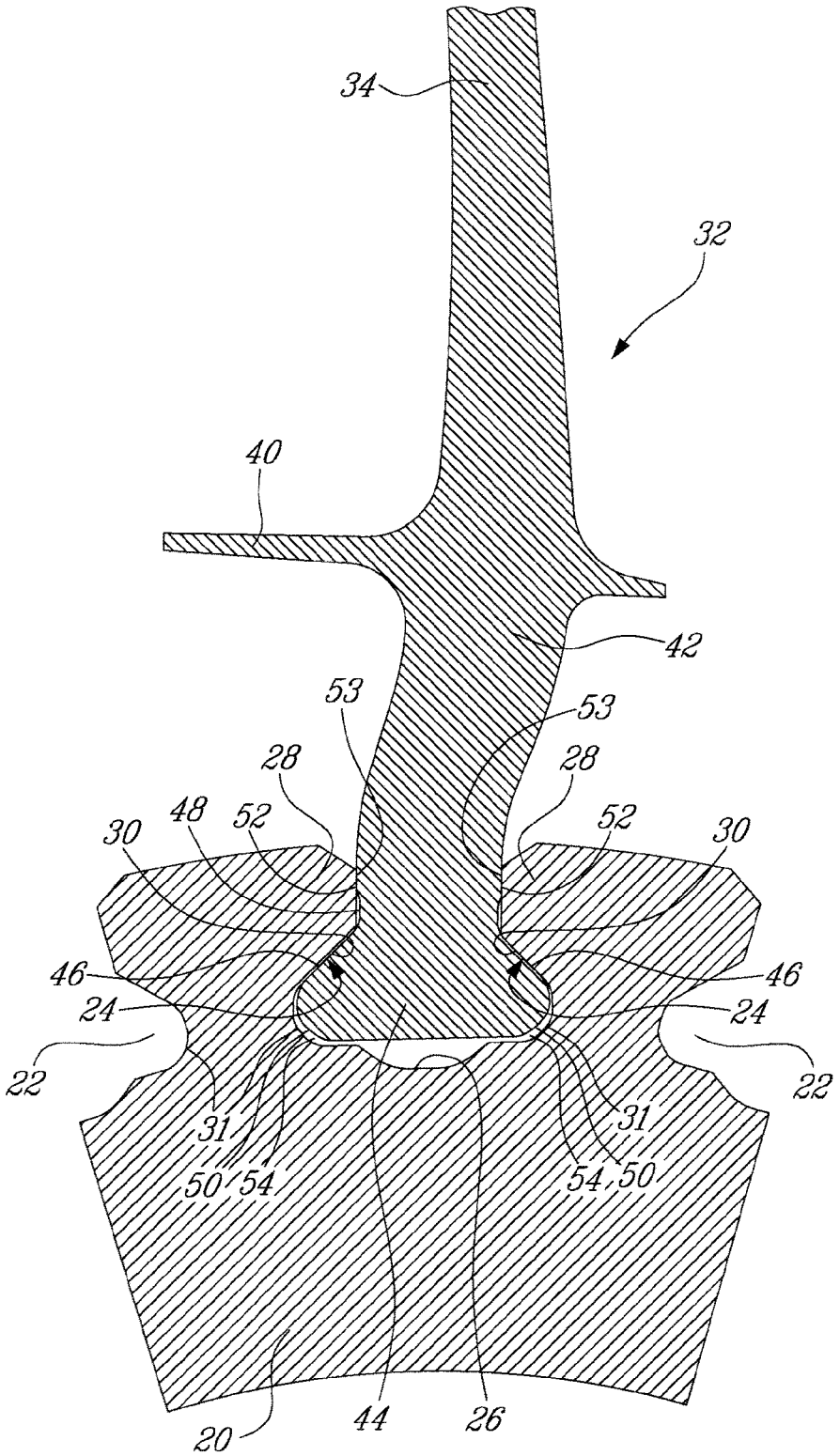
FIG. 3 is an enlarged cross-section view of a blade dovetail engaged in a dovetail slot of the fan disk shown in FIG. 2.

The fan 12 further includes a circumferential array of fan blades 32 attachable to the fan disk 20. The fan blades 32 are axially received in the blade mounting slots 22 of the disk 20. Each blade 32 comprises an airfoil portion 34 (FIG. 3) including a leading edge and a trailing edge. The airfoil portion 34 extends radially outwardly from a platform 40 (FIG. 3). A blade fixing portion or blade root 42 extends from the platform 40, opposite the airfoil portion 34, such as to connect the blade 32 to the disk 10. The blade root 42 includes an axially extending dovetail 44, which has a shape complementary to the slots 22 defined in the disk 20. The airfoil section 34, platform 40 and root 42 may be integral with one another. Bearing surfaces 46 on opposed flanks of each blade root 42 cooperate with the lug bearing surfaces 30 to lock the blades 32 radially to the disk 20. An axial system (not shown) axially lock the blades 32 to the disk 20.

During engine operation, the centrifugal force urges the bearing surfaces 46 of the blades 32 against the lug bearing surfaces 30, thereby firmly locking the blades 32 in position on the disk 20. However, when the rotational speeds are too low to urge the flanks of the blade dovetails 44 centrifugally against the bearing surfaces 30 of the lugs 28, such as when windmilling occurs, the blade dovetails 44 repeatedly rubs against the bounding surfaces of the blade mounting slots 22. This may lead to premature wear of the blade dovetails 44 and the disk 20.

Rubbing of high stress regions of the blade dovetail 44 and of the disk 20 particularly contributes to reduce the service-life of the blades 32 and of the disk 20 and should thus be avoided. An example of a high stress region is the neck portion 48 of the blade root 42. Another example of a high stress region is the bottom corner fillet region 31 of the blade mounting slots 22. It is desirable to protect such high stress regions from rubbing during slow or windmilling rotational speeds.

Figure 2:
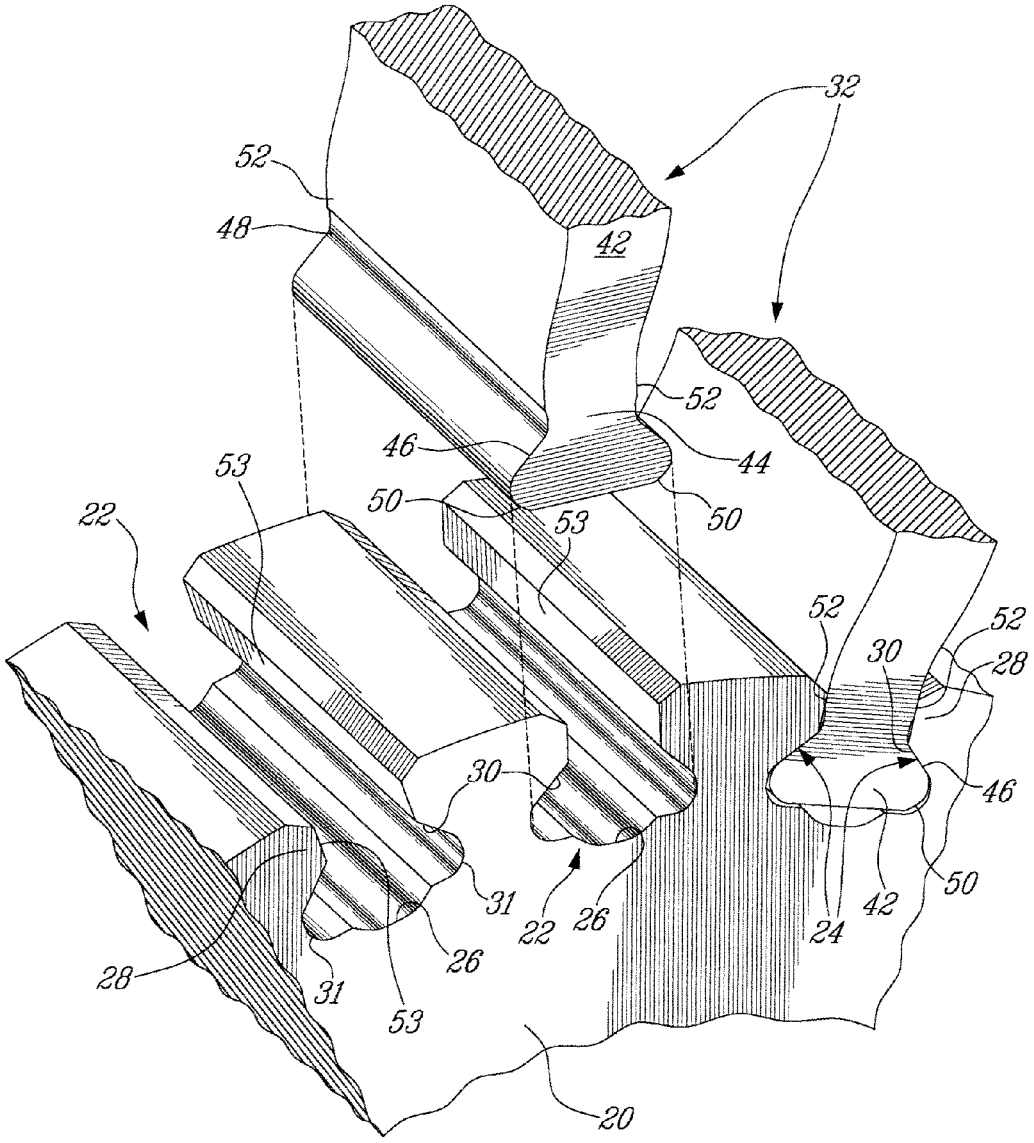
FIG. 2 is a partial perspective view showing a dovetail design of a fan rotor assembly according to an embodiment of the present invention.

With reference to FIGS. 2 and 3, it can be appreciated that the low stress regions of the blade dovetail 44 have a closer tolerance fit in the blade mounting slot 22 than the blade root high stress regions (e.g. the neck region 48). Accordingly, whenever there is a displacement of the blade dovetail 44 in the slot 22, the contact points between the blade dovetail 44 and the disk 22 will be in low stress regions of the blade, thereby shielding the high stress regions from contacting the disk 20. For instance, the flanks of the blade dovetail 44 can be locally thickened at a high radius that is at a location radially outward of the neck portion 48 to provide a bumper surface 52 (or sacrificial wear surface) which will engage corresponding bumper surfaces 53 provided on the disk 22 radially outwardly of the radially inwardly facing bearing surfaces 30 of the lugs 28. The bumper surfaces 52 and 53 protect the neck region 48 of the blade root 42 from rubbing against the slot sidewalls 24 of the disk 20. The bumper surfaces 52 and 53 are closed tolerances to limit blade movement during windmilling. The play between the bumper surfaces 52 and 53 is smaller than the play between the neck region 48 and the opposed facing surface of the slot sidewalls 24. The bumper surfaces 52 and 53 are designed to have a large contact area to reduce wear and to be in regions of low stress such that if wear does occur, it will still result in acceptable part durability. As can be appreciated from FIG. 3, the bumper surfaces 52 project further laterally outward and closer to the opposed slot sidewalls 24 of the disk 20 than the blade neck peak stress region, thereby shielding the blade peak stress regions from contacting the disk 20. Accordingly, during low speed rotation, such as during windmilling, only non-critical areas of the blade dovetail 44 (e.g. the thickened or bumper surface provided in low stress regions of the dovetail) will engage the disk 20, the critical high stress areas being shielded from contacting the disk 20. In other words, sacrificial wear surfaces are provided in non-critical low stress regions of the blade root 42 away from the known critical high stress regions so that windmilling only cause non-critical areas of the blades 32 to rub against the disk 20. The bumper surfaces 52 and 53 provide for a greater play between the blade root 42 and the disk 20 in the blade neck peak stress region. The bumper surfaces 52 and 53 may be coated, padded or otherwise treated to provide added resistance to wear.

The high stress bottom fillet region 31 of the disk slots 22 may be protected against windmilling induced wear by removing material or shaping the bottom corners 50 of the blade dovetails 44 so that the bottom corners 50 be somewhat recessed or spaced farther from the slot bottom fillet regions 31 than the adjacent low stress area of the blade dovetail 44. For instance, the blade root bottom corners can be rounded or chamfered to provide a play or gap 54 and thus avoid contact with the bottom fillet regions 31 during windmilling. The blade bottom corners 50 may be designed to have a smaller radius than that of the disk bottom fillet regions 31. The mated features adjacent to the fillet 31 act as bumpers in low stress region at the bottom of the blade/slot to shield the high stress bottom corner region of the slots 22.

The above description is meant to be exemplary only, and one skilled in the art will recognize that changes may be made to the embodiments described without departing from the scope of the invention disclosed. For example, it is understood that the above described dovetail details is not limited to fan rotor assembly but could also be applied to other types of rotor assembly, including compressor and turbine rotors. The general principals of the invention are not limited to straight dovetail designs and could also be applied to curved dovetail designs as for instance disclosed in U.S. Pat. No. 6,457,942. Still other modifications which fall within the scope of the present invention will be apparent to those skilled in the art, in light of a review of this disclosure, and such modifications are intended to fall within the appended claims.

What is claimed is:

1. A fan rotor assembly of a gas turbine engine, comprising a disk mounted for rotation about a centerline of the engine, an array of circumferentially distributed dovetail slots defined in an outer periphery of the disk, a corresponding array of fan blades attachable to the disk, each fan blade having a blade dovetail engageable in a corresponding one of the dovetail slots, the blade dovetail having high stress regions and low stress regions, the low stress regions having a sacrificial bumper which will wear in preference to the high stress regions of the blade dovetail, the sacrificial bumper providing for a closer tolerance fit of the low stress regions of the blade dovetail in the dovetail slots than the high stress regions, thereby shielding the high stress regions from rubbing against the disk when the rotational speed of the turbofan assembly is too low to centrifugally lock the fan blades in position on the disk, wherein each dovetail slot has a pair of outer overhanging lugs having radially inwardly facing bearing surfaces for engagement with corresponding bearing surfaces provided on opposed flanks of each blade dovetail, wherein the sacrificial bumper comprises a pair of bumper surfaces provided on each blade dovetail radially outwardly of the bearing surfaces thereof for engaging corresponding bumper surfaces provided at a mouth of each dovetail slot, wherein the bumper surfaces of the blade dovetails and the bumper surfaces of the dovetail slots are oriented to be in contact while the blades move radially inwardly and outwardly relative to the dovetail slots during windmilling, and wherein the high stress regions of the blade dovetails include a neck region disposed radially between the bumper surfaces and the bearing surfaces of the blade dovetails, the bumper surfaces shielding the neck region along a full axial extent thereof from contacting the disk when the fan rotor assembly rotates at low speed, and wherein contact points between the blade dovetails and the disk during windmilling are in the low stress regions only.

2. The fan rotor assembly according to claim 1, wherein the high stress regions are recessed relative to the low stress regions of the blade dovetails.

3. The fan rotor assembly according to claim 1, wherein the bumper surfaces at the mouth of each dovetail slots are disposed in opposed facing relationship and extend axially along an axial length of the dovetail slot.

4. The fan rotor assembly according to claim 1, wherein the bumper surfaces are coated to provide added resistance to wear.

5. The fan rotor assembly according to claim 1, wherein each dovetail slot has bottom disk fillets extending between a slot bottom and a pair of opposed radially inwardly facing bearing surfaces, the bottom disk fillets being a high stress region, and wherein a greater gap is defined between the bottom corners of the blade dovetails and the bottom disk fillet than between an adjacent low stress region of the dovetail blades and dovetail slots.

6. The fan rotor assembly according to claim 5, wherein the bottom corners of the blade dovetails have a smaller radius than that of the bottom disk fillets.

7. A gas turbine engine fan rotor assembly comprising a rotor disk mounted for rotation about an axis and having a plurality of fan blade mounting slots circumferentially distributed about a periphery of the rotor disk for receiving complementary blade fixing portions of a set of fan blades, wherein each blade fixing portion has low stress regions and high stress regions, and wherein bumper surfaces are provided in the low stress regions away from the high stress regions so that during windmilling when the rotational speed of the rotor assembly is too low to centrifugally lock the fan blades in position on the disk, the bumper surfaces contact the disk and shield the high stress regions from contacting the disk, thereby protecting the high stress regions of the blade fixing portions from windmilling induced wear, wherein the blade fixing portions are shaped so that only the low stress regions rub against the disk during windmilling induced movement of the blades in the blade mounting slots, wherein the high stress regions include a blade neck peak stress region having a length extending axially from a front end to a rear end of the blade fixing portion of each fan blade, and wherein the bumper surfaces include a pair of opposed axially extending sidewall surfaces disposed radially outwardly of the blade neck peak stress region relative to the axis of the rotor disk for engagement with corresponding axially extending bumper surfaces provided at a mouth of a corresponding one of said blade mounting slots, wherein the axially extending sidewall surfaces disposed radially outwardly of the blade neck peak stress region relative to the axis of the rotor disk and the corresponding axially extending bumper surfaces provided at the mouth of the corresponding one of said blade mounting slots are oriented to be in contact while the blades move radially inwardly and outwardly relative to the blade mounting slots during windmilling, the both corresponding bumper surfaces shielding blade neck peak stress region along the full length thereof from rubbing against the disk during windmilling.

8. The rotor assembly according to claim 7, wherein the bumper surfaces are designed to have a closer tolerance fit in the disk so that during windmilling induced movement of the blades in the slots, the bumper surfaces engage the disk to prevent the high stress regions of the blade fixing portion from rubbing against the disk.

9. The rotor assembly according to claim 7, wherein the low stress regions of the blade fixing portions are received in the slots with a closer tolerance fit than the high stress regions.

10. The rotor assembly according to claim 7, wherein each blade fixing portion has rounded bottom corners which are spaced farther from opposed facing bottom disk fillets of the blade mounting slots than immediate adjacent low stress regions of the blade fixing portions and of the blade mounting slots.

11. The rotor assembly defined in claim 7, wherein contact surfaces between the disk and the blades during windmilling are in low stress regions of the blade fixing portions only.

* * * * *